US011248341B2

(12) United States Patent
Meyer et al.

(10) Patent No.: US 11,248,341 B2
(45) Date of Patent: Feb. 15, 2022

(54) TENSIONING CABLE SPREADING DEVICE AND TENSIONING CABLE LUBRICATION DEVICE AND METHOD

(71) Applicant: Wobben Properties GmbH, Aurich (DE)

(72) Inventors: Ingo Meyer, Wiesmoor (DE); Karsten Albers, Hinte (DE); Joachim Jung, Hannover (DE)

(73) Assignee: Wobben Properties GmbH, Aurich (DE)

( * ) Notice: Subject to any disclaimer, the term of this patent is extended or adjusted under 35 U.S.C. 154(b) by 0 days.

(21) Appl. No.: 16/463,797

(22) PCT Filed: Nov. 28, 2017

(86) PCT No.: PCT/EP2017/080629
§ 371 (c)(1),
(2) Date: May 23, 2019

(87) PCT Pub. No.: WO2018/096165
PCT Pub. Date: May 31, 2018

(65) Prior Publication Data

US 2019/0284759 A1 Sep. 19, 2019

(30) Foreign Application Priority Data

Nov. 28, 2016 (DE) ..... 10 2016 122 905.9

(51) Int. Cl.
*D07B 7/18* (2006.01)
*D07B 7/12* (2006.01)

(52) U.S. Cl.
CPC ..... *D07B 7/185* (2015.07); *D07B 7/12* (2013.01); *D07B 7/18* (2013.01)

(58) Field of Classification Search
CPC ..... D07B 7/185; D07B 7/12
See application file for complete search history.

(56) References Cited

U.S. PATENT DOCUMENTS

| | | | | |
|---|---|---|---|---|
| 2,010,184 A | | 8/1935 | Fürth | |
| 4,422,208 A | | 12/1983 | Rohrbaugh | |
| 4,422,529 A | | 12/1983 | Johansen | |
| 4,498,558 A | * | 2/1985 | Bendahan | D07B 7/12 15/220.4 |

(Continued)

FOREIGN PATENT DOCUMENTS

| | | |
|---|---|---|
| AT | 5699 U1 | 10/2002 |
| DE | 60016582 T2 | 5/2005 |

(Continued)

*Primary Examiner* — Dah-Wei D. Yuan
*Assistant Examiner* — Stephen A Kitt
(74) *Attorney, Agent, or Firm* — Seed Intellectual Property Law Group LLP

(57) ABSTRACT

A device for spreading a multi-stranded tensioning cable, in particular steel tensioning cables, comprising a main body having a feedthrough opening for the entire tensioning cable, and a number of spreading elements which are arranged radially movably in the main body and each have a contour which is of a configuration tapering inwardly in the radial direction for engaging and producing a gap between respectively adjacent strands of the tensioning cable.

19 Claims, 4 Drawing Sheets

(56) References Cited

U.S. PATENT DOCUMENTS

| | | | | | |
|---|---|---|---|---|---|
| 5,263,307 | A * | 11/1993 | Hasui | D07B 1/144 57/1 UN |
| 2002/0134482 | A1 | 9/2002 | Takagi | |
| 2009/0077765 | A1 | 3/2009 | Heumann et al. | |
| 2015/0047140 | A1* | 2/2015 | Wright | D07B 7/02 15/121 |

FOREIGN PATENT DOCUMENTS

| | | | | |
|---|---|---|---|---|
| DE | 202014004947 | U1 | 11/2014 | |
| EP | 1321568 | A2 | 6/2003 | |
| FR | 437137 | * | 11/1911 | |
| FR | 437137 | A * | 4/1912 | D07B 7/18 |
| FR | 437137 | A | 4/1912 | |
| GB | 790551 | A | 2/1958 | |
| GB | 858832 | A | 1/1961 | |
| JP | S53101064 | U | 8/1978 | |
| JP | S55102457 | A | 8/1980 | |
| JP | 57-501635 | A | 9/1982 | |
| JP | 2002194683 | A | 7/2002 | |
| KR | 20100008801 | A | 1/2010 | |

* cited by examiner

TENSIONING CABLE SPREADING DEVICE AND TENSIONING CABLE LUBRICATION DEVICE AND METHOD

BACKGROUND

Technical Field

The present invention concerns a device for spreading a multi-stranded tensioning cable, in particular steel tensioning cables. The invention further concerns a device for lubricating a multi-stranded tensioning cable, in particular a steel tensioning cable. Moreover the invention concerns a method of spreading a multi-stranded tensioning cable, in particular a steel tensioning cable, and a method of lubricating a multi-stranded tensioning cable, in particular a steel tensioning cable.

Description of the Related Art

Devices and methods of the above-indicated kind are necessary in industry for preparing tensioning cables, in particular steel tensioning cables, for sheathing with plastic sheaths. In order to combat corrosion on the one hand and wear as a result of friction on the other hand a certain amount of lubricant, in particular grease, has to be provided between the strands of the tensioning cable as that is no longer possible subsequently, as soon as the plastic sheath has been placed around the cable.

Generally known sheathing apparatuses which operate by means of plastic extrusion are used for applying the plastic sheath.

Spreading the tensioning cable has proven to be a work-intensive and time-intensive preparation step in the state of the art. Usually that is effected by the tensioning cable being spread out into the individual strands at its cable end, and by each of the strands being introduced into an individual feedthrough opening in a spreading ring which has a number of individual feedthrough openings, that is matched to the tensioning cable. That spreading ring is then moved along the cable by the application of force or is held stationary and the cable is drawn through the spreading ring by the application of force. In the spread condition it is possible for lubricant like for example grease to be introduced into the interior of the tensioning cable.

A continuous mode of production however is not possible with the devices and methods in the state of the art. At the beginning each cable has to be manually inserted into the spreading ring. Cable groups which consist of two tensioning cables and which are joined at the transitional locations, for example by means of clamping or welding, can generally not be processed in this way as the spreading ring cannot be drawn over those junction locations or the cable with the junction location cannot be pulled past the spreading ring.

On the application for which priority is claimed for the present application the German Patent and Trade Mark Office searched the following state of the art: DE 20 2014 004 947 U1, DE 600 16 582 T2, and U.S. Pat. No. 2,010,184 A.

BRIEF SUMMARY

Provided is a device for spreading a multi-stranded tensioning cable, with which spreading is facilitated, which in particular makes it possible to insert lubricant into the interior of the tensioning cable without having to thread in the start of the tensioning cable and which in addition in particular permits a continuous mode of production.

In a device for spreading a multi-stranded tensioning cable, in particular steel tensioning cables is provided. It is proposed that the device has a main body having a feedthrough opening for the entire tensioning cable, and a number of spreading elements which are arranged radially movably in the main body and each have a contour which is of a configuration tapering inwardly in the radial direction for engaging and producing a gap between respectively adjacent strands of the tensioning cable. The tensioning cable in accordance with this concept does not have to be frayed open at its cable end into the individual strands, but the entire tensioning cable is introduced into a common feedthrough opening so that the spreading elements can act from the exterior on the exposed strands of the tensioning cable. The invention makes use of the realization that large spacings between the strands of the tensioning cable are not required. Small gaps are already sufficient for introducing lubricant like for example grease. It is precisely those small gaps that can be produced by very slight displacement movements in a lateral direction in relation to the radial movement of the spreading elements, by the spreading elements encountering the strands from the exterior, engaging into interstices between the strands and displacing the strands towards the side to such an extent that a small gap is produced between the strands. According to the invention the term strand of the tensioning cable is used to denote both a wire and also a braid. According to the invention the term number of strands or plurality of strands is used to denote a number including 1 and a whole multiple of 1. Particularly preferably the device has 2, 3, 4 or 6 spreading elements.

In a preferred embodiment the spreading elements are of a pin-shaped configuration. Particularly preferably the spreading elements are substantially cylindrical spreading mandrels which at their radially inward end, relative to the feedthrough opening, have a point tip adapted for spreading.

In an alternative and equally preferred embodiment the spreading elements each have a spreading roller mounted rotatably in a radially movable piston. The radial mobility of the piston also relates to the feedthrough opening. The advantage of the spreading rollers lies in the reduced sliding friction when drawing the tensioning cable through the device for spreading the tensioning cable.

In a further preferred embodiment the main body is mounted in the device rotatably about an axis of rotation, at any event through a predetermined angular range, wherein the axis of rotation extends substantially parallel and in particular coaxial in relation to a feedthrough direction of the tensioning cable through the feedthrough opening. By virtue of easy rotatability of the main body it is possible to use even tensioning cables which are twisted in themselves and in which the strands do not extend in a straight line but are twisted for example in a spiral shape. The main body then easily involves the rotational movement produced as a consequence of the twist when the tensioning cable is drawn through the feedthrough opening. Slight irregularities in the orientation of the strands in the case of otherwise substantially untwisted tensioning cables can also be ensured by the at least limited rotatability of the main body.

According to a preferred embodiment, the spreading elements are respectively arranged in the main body radially movably by means of a thread. Screwing the spreading elements into the thread makes it possible quite accurately to adjust how great the degree of spreading of the tensioning cable is to be, as well as easily ensuring adaptation to different tensioning cable diameters. If the thread has a sufficiently low thread pitch, for example in the form of a self-locking thread, spontaneous displacement of the spreading elements is also almost out of the question. As an additional safeguard it is for example possible to provide locking elements or other fixing mechanisms.

In a further preferred embodiment the spreading elements are respectively actuated hydraulically or pneumatically. In preferred configurations the spreading elements each have a piston surface arranged in a piston chamber, wherein the piston chamber can be respectively acted upon with a fluid pressure. For that purpose the piston chambers are preferably in fluid-conducting relationship to an in particular common control pressure line.

In a further preferred embodiment the spreading elements are each electromagnetically actuated.

In a particularly preferably embodiment the spreading elements are adapted to be respectively deflected by means of a wedge slider. Particularly preferably the respective wedge sliders are arranged guided movably in the feedthrough direction of the steel tensioning cable. The spreading elements are preferably moved inwardly or outwardly in the radial direction by rolling or sliding along the at least one wedge slider. Particularly preferably for that purpose the spreading elements have a rolling body or a slide surface which is in operative relationship with the wedge slider. The wedge sliders in turn are driven for example mechanically, electromagnetically, pneumatically or hydraulically.

In a further aspect as mentioned in the opening part of this specification the invention also concerns a device for lubricating a multi-stranded tensioning cable, in particular steel tensioning cables. Provided is a device comprising a feedthrough passage for the tensioning cable, a lubricant passage which opens into the feedthrough passage and which is in fluid-conducting relationship with at least one pressure generator, wherein a device according to one of the above-described preferred embodiments is associated with the lubricant passage.

In accordance with that aspect the invention enjoys the advantages of the spreading device for automated lubrication. In particular it is no longer necessary for the cable to be previously spread open manually from the beginning of the cable by means of a conventional spreading ring and for the first time automated continuous production of a lubricated tensioning cable for feeding to a sheathing apparatus becomes possible.

In regard to the advantages and preferred embodiments of the device for lubricating the cable attention is directed to the foregoing embodiments and description.

Preferably the device for spreading the tensioning cable is arranged in the feedthrough passage.

The at least one pressure generator is preferably adapted to convey lubricant under an increased pressure through the lubricant passage into the feedthrough passage. By filling the feedthrough passage in which particularly preferably the spreading device is also arranged with increased pressure this provides that the entire feedthrough passage is constantly filled with lubricant.

In a further preferred embodiment the device has a first lubricant passage arranged upstream of the spreading device and a second lubricant passage arranged downstream of the spreading device. While the first lubricant passage preferably serves to introduce lubricant into the feedthrough passage, which is then provided for penetrating into the spread tensioning cable, the second lubricant passage is provided for introducing lubricant into the feedthrough passage in order that the tensioning cable which is already lubricated in its interior is also additionally lubricated on its exterior.

In a further preferred embodiment the device has a lubricant stripper arranged at the outlet end of the feedthrough passage and dimensioned to strip excess lubricant off and keep it in the feedthrough passage so that the tensioning cable issues from the feedthrough passage from a defined lubricant film with a mean outside lubricant diameter defined by the lubricant stripper.

The at least one pressure generator is particularly preferably adapted in dependence on the conveyor speed of the tensioning cable through the feedthrough passage to deliver a predetermined amount of lubricant through the lubricant passage. Further preferably the at least one pressure generator is adapted to deliver lubricant at a delivery rate in a region of about 25 g/meter of tensioning cable or more, further preferably 50 g/meter of tensioning cable or more, in particular in a region of 55 g/meter to 100 g/meter of tensioning cable.

In a further aspect the invention concerns a method of spreading a multi-stranded tensioning cable, in particular steel tensioning cables. Provided is a method including the steps:

passing the tensioning cable through a feedthrough opening, moving a number of spreading elements radially inwardly within the feedthrough opening so that the spreading elements engage between adjacent strands, and produce a gap between the adjacent strands.

The features described hereinbefore in relation to the two device aspects, in particular in respect of their functional features, are at the same time preferred embodiments and configurations of the method for spreading a tensioning cable. In that respect attention is directed to the foregoing description.

In a further aspect the invention concerns a method of lubricating a multi-stranded tensioning cable, in particular steel tensioning cables. Provided is a method including the steps: passing the tensioning cable through a feedthrough passage, delivering lubricant on to the tensioning cable within the feedthrough passage, and spreading the tensioning cable before delivery of the lubricant, wherein spreading is effected in accordance with one of the above-described and preferred embodiments. The lubrication method according to the invention also makes use of the embodiments and advantages described hereinbefore with reference to the devices according to the invention.

In a further aspect the invention concerns the use of a device comprising a main body having a feedthrough opening for the entire tensioning cable, and a number of spreading elements which are arranged radially movably in the main body and which are of a contour of a configuration tapered inwardly in the radial direction for spreading a multi-stranded tensioning cable, in particular steel tensioning cables, wherein the spreading elements engage between respectively adjacent strands of the tensioning cable and produce a gap between the adjacent strands.

BRIEF DESCRIPTION OF THE SEVERAL VIEWS OF THE DRAWINGS

The invention is described in greater detail hereinafter with reference to the accompanying Figures by means of two preferred embodiments. In the Figures.

DETAILED DESCRIPTION

Figure 1B:
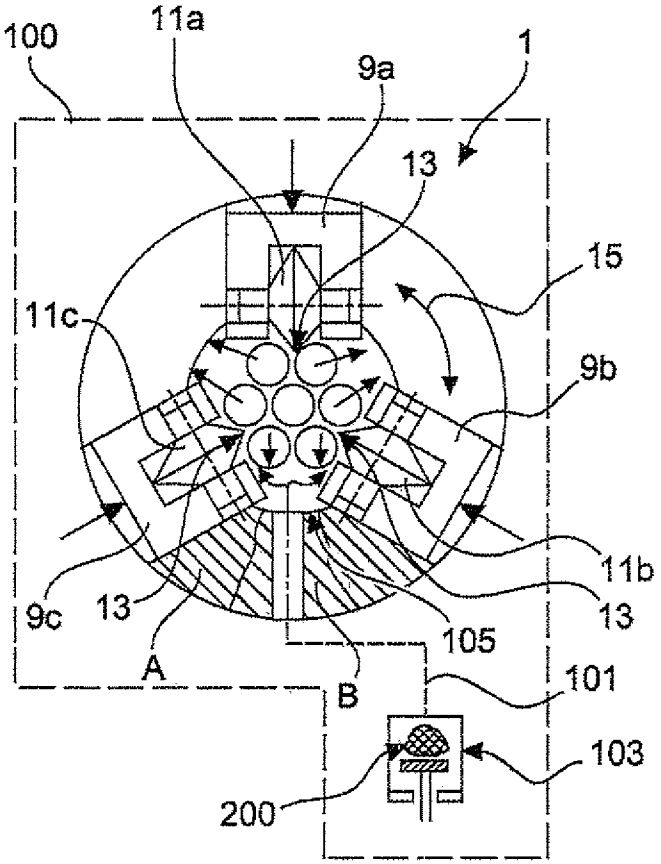
FIG. 1*b* shows a diagrammatic view of a lubricating and spreading device according to a second preferred embodiment.
Figure 1A:
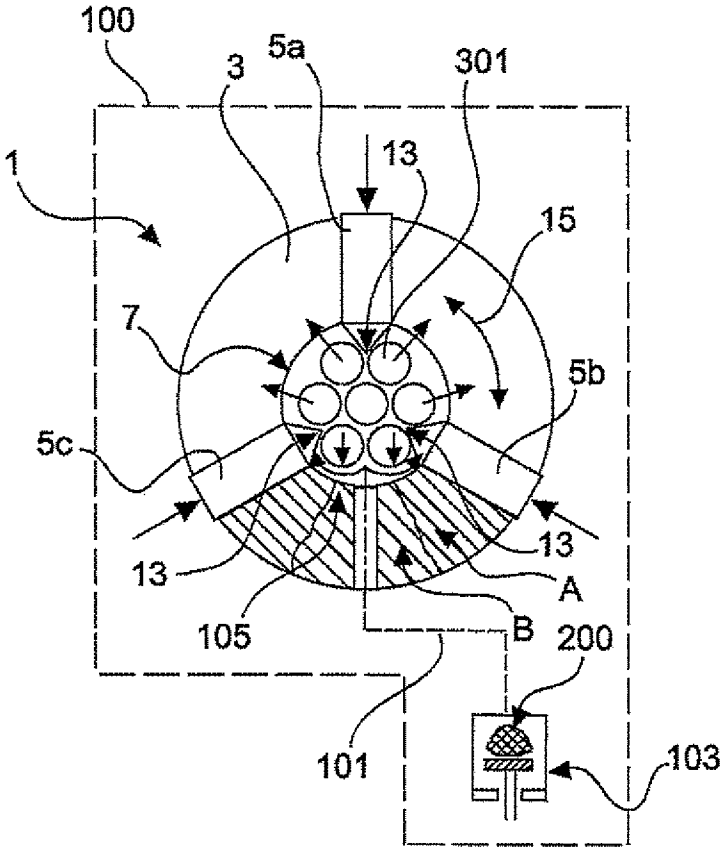
FIG. 1*a* shows a diagrammatic view of a lubricating and spreading device according to a first preferred embodiment.

FIG. 1*a* shows a lubricating device 100 for lubricating a steel tensioning cable 301 comprising a plurality of strands. The lubricating device 100 has a spreading device 1 for spreading the multi-stranded steel tensioning cable 301. The spreading device 1 has a main body 3 in which a number of spreading elements 5*a*, 5*b*, 5*c* are radially movably arranged. In this respect radial mobility relates to a feedthrough opening 7 in the main body 3. The spreading elements 5*a*, 5*b*, 5*c* are therefore movable substantially towards and away from the center of the feedthrough opening 7. On their side which is radially inward relative to the feedthrough opening 7 the spreading elements 5*a*, 5*b*, 5*c* are of a tapered contour adapted to engage between adjacent strands of the steel tensioning cable 301 and to displace same laterally in such a way, as indicated by small arrows, that a small gap 13 is produced between the adjacent strands of the steel tensioning cable 301. Lubricant 200 is pressed through that narrow gap which is in a lubrication plane B downstream of the spreading location (shown in the section plane A) through a lubricating passage 101, into a feedthrough passage 105 which is preferably coaxial with the feedthrough opening 7 of the spreading device 1. That is preferably effected by means of a lubricant supply having a pressure generator 103 which is preferably controlled electronically and which in dependence on the conveyor speed of the steel tensioning cable 301 through the feedthrough passage 105 delivers a predetermined delivery rate of lubricant 200.

The main body 3 is preferably rotatable or pivotable in the direction of the arrows 15, at least by a given angular amount. The axis of rotation is preferably the designated central axis of the feedthrough opening 7 or feedthrough passage 105.

The second embodiment shown in FIG. 1*b* is structurally very similar to the embodiment of FIG. 1*a*. Identical or functionally identical components are denoted by the same references. Unlike the embodiment of FIG. 1*a* in which the spreading elements 5*a*-5*b* are of a pin-shaped configuration the spreading elements 9*a*-9*c* in the second embodiment respectively have spreading rollers 11*a*-11*c* mounted rotatably in the piston-shaped spreading elements 9*a*-9*c*. The displacement operation however is substantially the same. In a spreading plane A the spreading elements 11*a*-11*c* are moved radially inwardly whereby they engage between adjacent strands of the steel tensioning cable 301 and displace the adjacent strands respectively in the direction of the small arrows so that respective gaps 13 are formed between the adjacent strands, through which gaps lubricant 200 can then be introduced through a lubricant passage 101 in an adjacent lubrication plane B.

The spreading elements 5*a*-5*c* and 9*a*-9*c* are preferably actuated hydraulically or pneumatically, or electromagnetically. Alternatively the spreading elements 5*a*-5*c* and/or 9*a*-9*c* are radially movable mechanically by means of screw-thread displacement.

Figure 2:
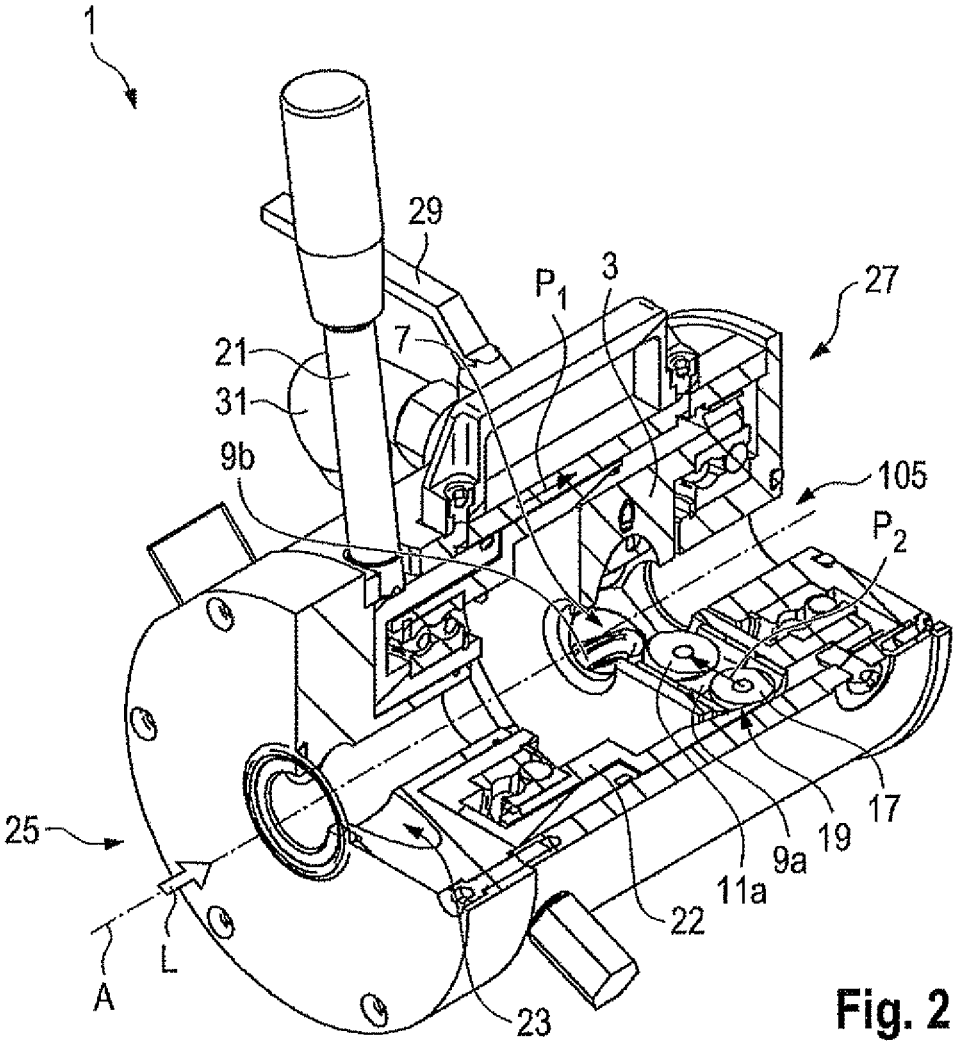
FIG. 2 shows a diagrammatic perspective partial view of the lubricating and spreading device of FIG. 1*b*.
Figure 3:
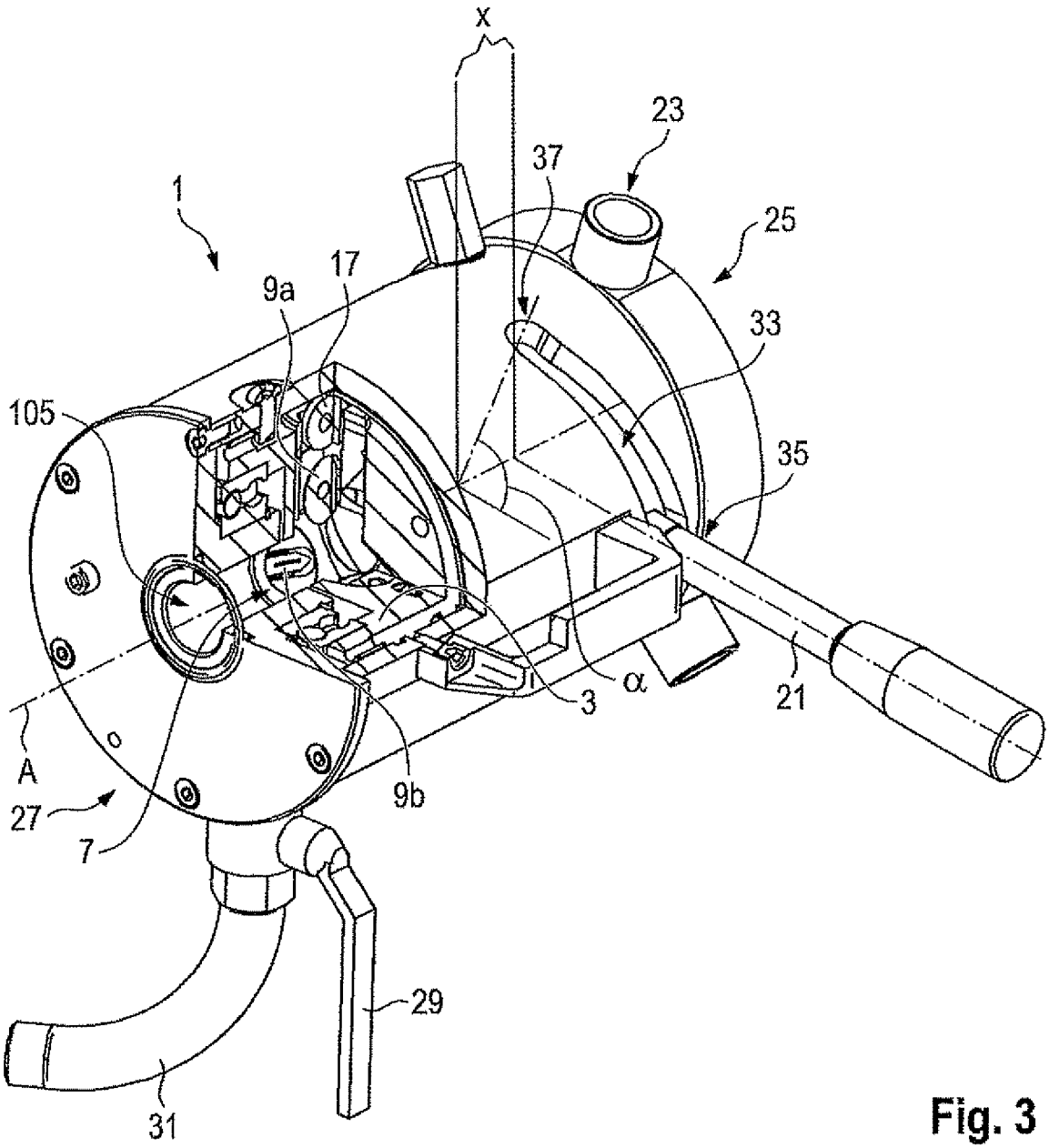
FIG. 3 shows a further perspective view of a part of the lubricating and spreading device of FIG. 2.

FIGS. 2 and 3 respectively show sectional views of the lubricating and spreading device. For the sake of simplicity here the spreading elements 9*a*-9*c* are respectively formed in accordance with the embodiment of FIG. 1*b*. The specific description is to be interpreted in such a way that, instead of the configuration shown in FIG. 1*b*, it is also possible to provide the spreading device of FIG. 1*a* in the arrangement shown in FIGS. 2 to 4.

FIG. 2 shows a partial section through the spreading device 1. The feedthrough passage 105 and the feedthrough opening 7 in the main body 3 are oriented coaxially in relation to the longitudinal axis A. The direction of travel of the tensioning cable is indicated by the arrow L. Particular attention is applied in FIG. 2 to actuation of the spreading elements (spreading elements 9*a*, 9*b*). Arranged at the spreading elements 9*a*, 9*b* are respective rolling bodies 17 which are in operative relationship with a wedge surface 19. The wedge surface 19 is provided on a cylindrical hollow body 22 which is movable with a translatory movement in the direction of the arrow P1, substantially parallel to the axis A. By displacement of the hollow body 22 and the associated wedge surface 19 in the direction of the arrow P1 the rolling bodies 17 are moved substantially radially towards the axis A in the direction of the arrow P2. The movement of the hollow body 22 is triggered by a lever 21 provided on the spreading device 1 (see below in relation to FIG. 3).

The spreading device 1 has a tensioning cable inlet side 25 and an oppositely arranged tensioning cable outlet side 27. Fitted to the housing of the spreading device 1 on the inlet side 25 is a flange in which there is an intake opening 23 for the feed of lubricant 200 into the feedthrough passage 105. The entire interior, that is to say the feedthrough passage 105 and the feedthrough opening 7, can be filled with lubricant 200 by means of that intake opening 23.

The spreading device further has a manifold 31 which is in fluid-conducting communication with the feedthrough passage 105 and which can be opened and closed by means of a shut-off element 29. Lubricant can be selectively let out of the feedthrough passage 105 by means of that manifold.

As can further be seen from FIG. 3 the lever 21 which represents the mechanical drive for the spreading elements (indicated at 9*a*, 9*b*) is movably guided in a sliding guide 33. The lever 21 is pivotable from a first starting position 35 into a second starting position 37. The first starting position 35 represents an open position in which the tensioning cable is passed substantially unimpeded through the feedthrough passage while the spreading elements in the second starting position 37 are disposed in a spreading position, penetrate into the tensioning cable and spread it. The sliding guide 33 is of a spiral configuration with respect to the axis A so that the lever position in the second starting position 37 is rotated through an angle alpha relative to the first starting position 35 and is displaced by a displacement x in the direction of the axis A. That displacement corresponds to the movement of the wedge surface 19 (FIG. 2) which in dependence on the angle of the wedge surface results in a radial movement of the spreading elements (9*a*, 9*b*).

Figure 4:
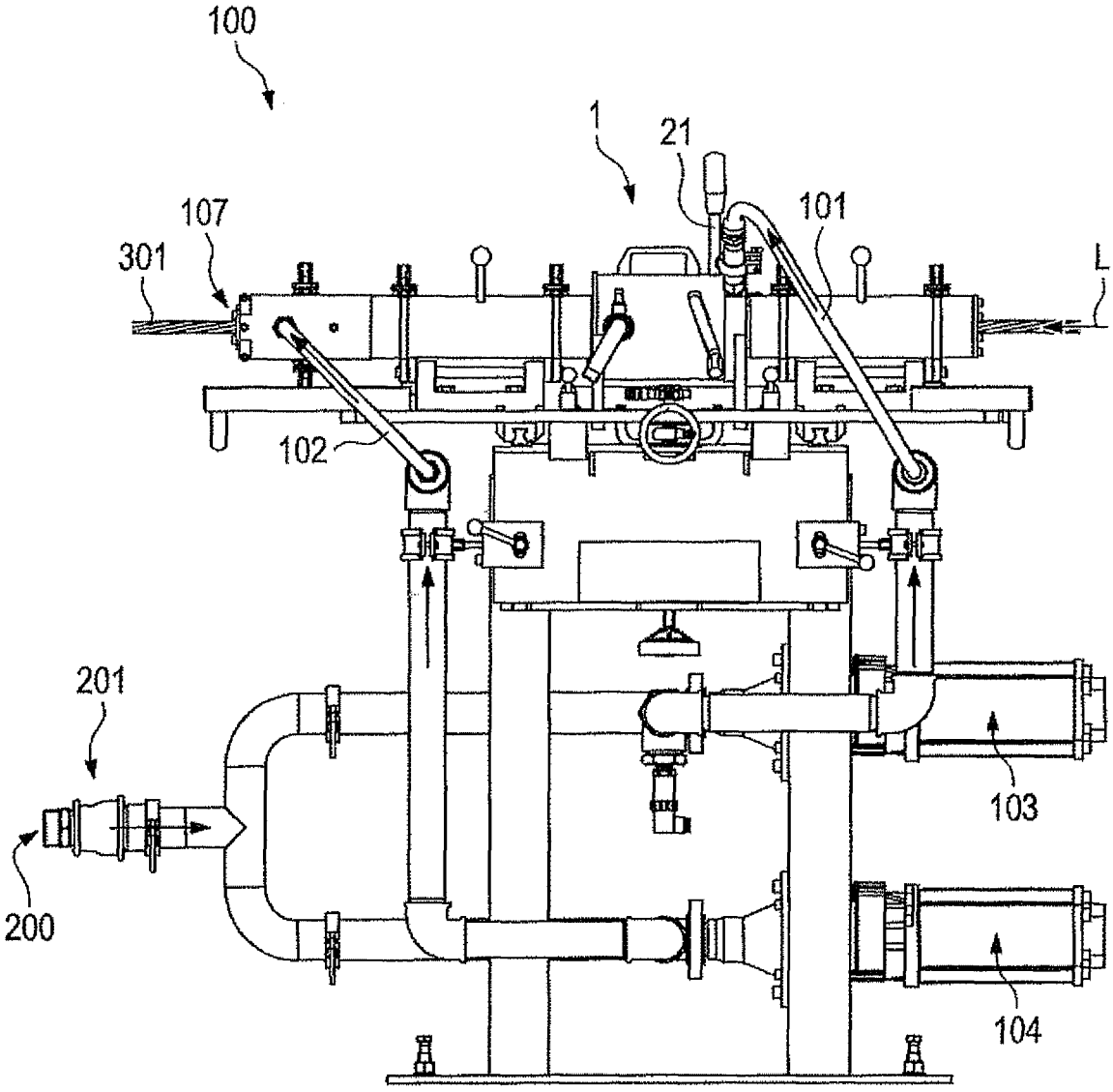
FIG. 4 shows a complete diagrammatic view of the lubricating and spreading device shown in the previous Figures.

FIG. 4 shows by way of example a diagrammatic view of the complete lubricating device 100. The lubricating device 100 has an entry 201 for the feed of lubricant 200. The entry 201 is connected in fluid-conducting relationship to the first lubricant passage 101 (see FIGS. 1*a*, 1*b*) and a lubricant passage 102. Preferably at least one pressure generator is interposed as part of the lubricant discharge device. In the present embodiment a first pressure generator 103 and a second pressure generator 104 are provided for the two lubricating passages 101 and 102. With the two pressure generators 103, 104 it is possible to predetermine the pressure of the first lubricant passage 101 independently of the pressure of the second lubricant passage 102.

While the first lubricant passage 101 feeds lubricant into the feedthrough passage 105 (FIGS. 2 and 3) upstream of the spreading device 1 the second lubricant passage 102 is arranged downstream of the spreading device 1 and feeds lubricant subsequently from the exterior into the feedthrough passage 105. In particular the proportion of lubricant which was supplied by means of the second lubricant passage 102 contributes to lubricating the tensioning cable 301 at its periphery. Excess lubricant is removed from the tensioning cable 301 by means of a stripper 107 arranged at the outlet end at the lubricating device 100 so that on issuing from the lubricating device 100 the tensioning cable 301 has a lubricant film of defined thickness.

The invention claimed is:

1. A device for lubricating a multi-strand tensioning cable, the device comprising:

a body having:

a feedthrough passage for receiving the multi-strand tensioning cable;

a lubricant passage which opens into the feedthrough passage, wherein the lubricant passage is in fluid communication with at least one pressure generator; and a spreading device for spreading the multi-strand tensioning cable, wherein the spreading device is associated with the lubricant passage and has a main body having a feedthrough opening for receiving the multi-strand tensioning cable, the main body having a plurality of spreading elements arranged to move radially in the main body, each of the plurality of spreading elements having a contour that tapers inwardly in a radial direction configured to engage and produce a gap between respectively adjacent strands of the multi-strand tensioning cable to place the multi-strand tensioning cable in a spread configuration while in the feedthrough passage, wherein the spreading device is configured to return the multi-strand tensioning cable to a twisted configuration.

2. The device according to claim 1, wherein each of the plurality of spreading elements is of a pin-shaped configuration.

3. The device according to claim 1, wherein each of the plurality of spreading elements has a spreading roller mounted rotatably in a radially movable piston.

4. The device according to claim 1, wherein:

the main body is mounted in the device rotatably about an axis of rotation; and the axis of rotation is oriented substantially parallel to a feedthrough direction of the multi-strand tensioning cable at the feedthrough opening.

5. The device according to claim 4, wherein the axis of rotation is oriented coaxial relative to the feedthrough direction of the multi-strand tensioning cable through the feedthrough opening.

6. The device according to claim 1, wherein the plurality of spreading elements are respectively arranged in the main body radially movably by a thread.

7. The device according to claim 1, wherein the plurality of spreading elements are adapted to be deflected by at least one wedge slider.

8. The device according to claim 7, wherein the plurality of spreading elements are adapted to be moved inwardly or outwardly in the radial direction by rolling or sliding along the at least one wedge slider.

9. The device according to claim 1, wherein the lubricant passage is a first lubricant passage arranged upstream of the spreading device, the device further comprises a second lubricant passage arranged downstream of the spreading device.

10. The device according to claim 1, comprising a lubricant stripper arranged at an outlet end of the feedthrough passage, the lubricant stripper being dimensioned to strip off excess lubricant and retain the excess lubricant in the feedthrough passage.

11. The device according to claim 1, wherein the device is configured to spread the multi-strand tensioning cable in the feedthrough passage.

12. The device according to claim 1, wherein the at least one pressure generator is configured, in dependence on a conveyor speed of the multi-strand tensioning cable through the feedthrough passage, to deliver a predetermined amount of lubricant through the lubricant passage.

13. The device according to claim 12, wherein a delivery rate of the predetermined amount of lubricant is at least 25 g per meter of the multi-strand tensioning cable.

14. The device according to claim 13, wherein the delivery rate of the predetermined amount of lubricant is between 55 g per meter of the multi-strand tensioning cable to 100 g per meter of the multi-strand tensioning cable.

15. The device according to claim 1, wherein the multi-strand tensioning cable includes steel tensioning cables.

16. A method comprising:

passing the multi-strand tensioning cable through the feedthrough passage of the device according to claim 1, spreading the multi-strand tensioning cable to the spread configuration, delivering lubricant on to the multi-strand tensioning cable within the feedthrough passage, and returning the multi-strand tensioning cable to the twisted configuration.

17. The method according claim 16, wherein delivering the lubricant comprises using the at least one pressure generator, wherein the at least one pressure generator is adapted to deliver lubricant at a delivery rate of at least 25 g per meter of the multi-strand tensioning cable.

18. The method according to claim 17, wherein the delivery rate is between 55 g per meter of the multi-strand tensioning cable to 100 g per meter of the multi-strand tensioning cable.

19. The method according to claim 16, wherein the multi-strand tensioning cable includes steel tensioning cables.

* * * * *